US006381427B1

(12) United States Patent
Bertram et al.

(10) Patent No.: US 6,381,427 B1
(45) Date of Patent: Apr. 30, 2002

(54) TRANSFER ROLLER CLEANING

(75) Inventors: Gary B. Bertram, Honeoye Falls; Philip Stern, Spencerport; George R. Walgrove, III, Rochester, all of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/808,491

(22) Filed: Mar. 14, 2001

(51) Int. Cl.[7] ..... G03G 15/16; G03G 21/00
(52) U.S. Cl. ..... 399/101; 15/256.52
(58) Field of Search ..... 399/101, 353, 399/9, 34, 297; 15/256.52

(56) References Cited

U.S. PATENT DOCUMENTS

| | | | | | |
|---|---|---|---|---|---|
| 3,847,119 | A | * | 11/1974 | Hoffman et al. | 399/101 |
| 4,081,212 | A | * | 3/1978 | Wetzer | 399/101 |
| 4,264,190 | A | * | 4/1981 | Tsuda et al. | 399/353 X |
| 5,101,238 | A | * | 3/1992 | Creveling et al. | 399/101 |
| 6,175,711 | B1 | * | 1/2001 | Yoshino et al. | 399/297 |

* cited by examiner

*Primary Examiner*—Joan Pendegrass
(74) *Attorney, Agent, or Firm*—Jaeckle Fleischmann & Mugel, LLP

(57) ABSTRACT

A high speed copier 10 has a transfer roller 42 and a cleaning brush 52. The cleaning performance is improved when the engagement of the two rollers exceeds a first threshold T1. Their engagement is maintained below a stall threshold T2.

10 Claims, 4 Drawing Sheets

TRANSFER ROLLER CLEANING

BACKGROUND

High speed printers and copiers such as those made and sold by Heidelberg Digital, assignee of this patent, use a biased transfer roller to transfer toner or developing material from a developed image on a photo conductor or equivalent film to a receiver sheet. The transfer roller is electrostatically biased to transfer charged toner particles from the surface of the photo conductor or equivalent film to a receiver sheet such as paper. During a normal operation residual toner on the photo conductor or equivalent film attaches to the surface of the transfer roller. To prevent that residual toner from transferring to the back surface of the following receiver sheet, an acrylic fiber brush rotates, engages the surface of the transfer roller, and removes residual toner particles. The toner on the bush is carried past a vacuum cleaning station that removes the toner and deposits it in a waste receptacle.

High speed printers and copiers may generate in excess of 100 copies per minute. In one day they can generate thousands of copies. The residual toner particles may accumulate on the transfer roller and cause unwanted markings on copies. Often such unwanted markings are not detected until after a large print job is completed. Such unwanted markings are unacceptable and many large print and copy jobs must be redone. The unwanted markings cause a waste of paper that is costly to the user, is inefficient, and adversely impacts wood and paper resources. The transfer roller may have to be manually cleaned. That reduces the productivity of the copier/printer and adds unwanted maintenance costs to the user of the copier/printer. Because the transfer roller is driven by the photo conductor or equivalent film or a drum, it is conventional to set the engagement between the transfer roller and the cleaning brush to avoid slipping or stalling the transfer roller. A stalled transfer roller will smear copies and likewise ruin a large print job. Accordingly, there has long been an unmet need to improve cleaning of transfer rollers in high speed copiers and printers without stalling the transfer roller.

SUMMARY

The invention improves the transfer roller cleaning operation in copiers and printers. It provides design criteria for selecting the engagement between the transfer roller and the cleaning brush. The criteria include selecting an engagement distance for pressing together the transfer roller and cleaning brush without slipping or stalling the transfer roller and smearing the receiver sheet with toner. The criteria include selecting a fiber density for the cleaning brush from a range of densities in accordance with the engagement force between the rollers. By using the invention those who are skilled can improve the cleaning performance of copiers and printers. As a result, there are fewer ruined print jobs and less downtime for cleaning transfer rollers.

One feature of the invention is a method for adjusting a transfer roller cleaning station to provide efficient and improved cleaning of the transfer roller. The transfer roller is frictionally driven by an endless belt photo conductor or equivalent film or a drum. That film carries a developed image past the transfer roller where the image is transferred to a receiver sheet. A cleaning station removes residual toner particles from the transfer roller. The cleaning station includes a cleaning brush with a plurality of fibrous bristles that extend from the cleaning brush toward the transfer roller. The force of the bristles against the transfer surface is adjusted by moving the cleaning brush toward the transfer roller. Once the desired engagement is selected, the cleaning brush is locked into position and maintains a relatively constant engagement on the transfer roller. The cleaning brush is driven by its own motor in a direction opposite to the direction of the transfer roller.

Conventional means are used for determining stall torque for slowing or stopping the rotation of the transfer roller. The cleaning brush is moved to engage its bristles against the transfer roller with an initial force that is sufficient to deflect the bristles against the transfer roller and begin removing at least some residual developing material from the transfer roller. The cleaning brush is moved in small, incremental steps toward closer engagement with the transfer roller. At each step, the performance of the cleaning of the transfer roller is recorded. The cleaning performance improves little or none until a first engagement threshold is exceeded. Thereafter, cleaning performance continuously improves until the stall torque is reached. Cleaning performance also improves as the density of the fibrous bristles on the cleaning brush increases. Thus, cleaning performance below the stall torque is improved by increasing the engagement force and by increasing the density of the bristles in the cleaning brush.

DRAWINGS

Figure 3A:
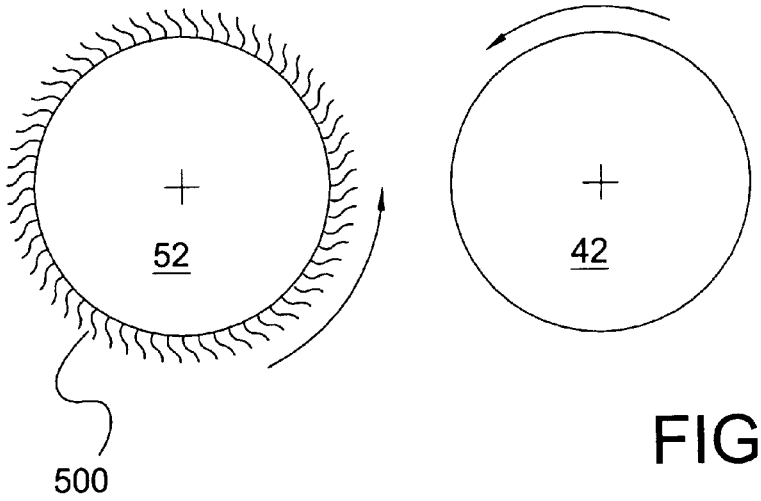

FIG. 3*a* is a further schematic showing the transfer roller and the cleaning brush before engagement.

Figure 3B:
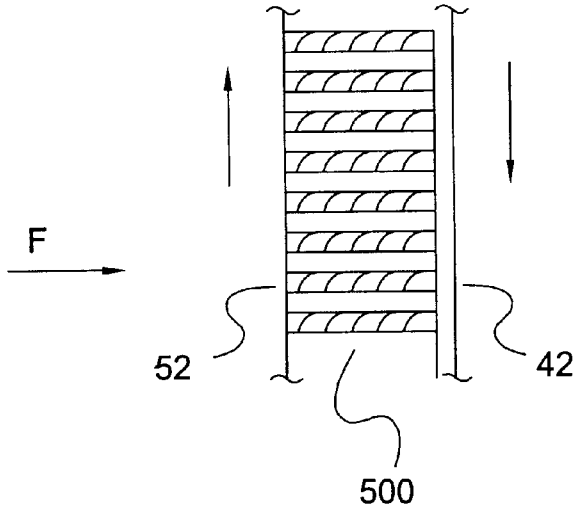

FIG. 3*b* is an enlarged schematic corresponding to a portion of FIG. 3*a*.

Figure 3C:
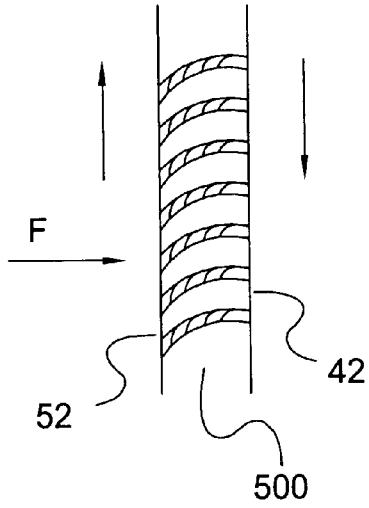

FIG. 3*c* is an enlarged schematic showing the fibers of the cleaning brush deflecting under the engagement force between the rollers.

Figure 4A:
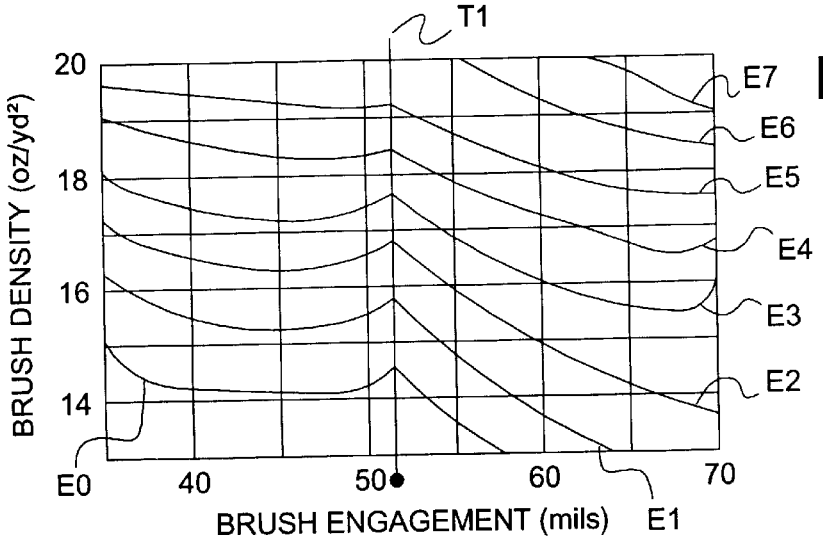

FIG. 4*a* is a contour plot showing improved cleaning above a threshold engagement.

Figure 4B:
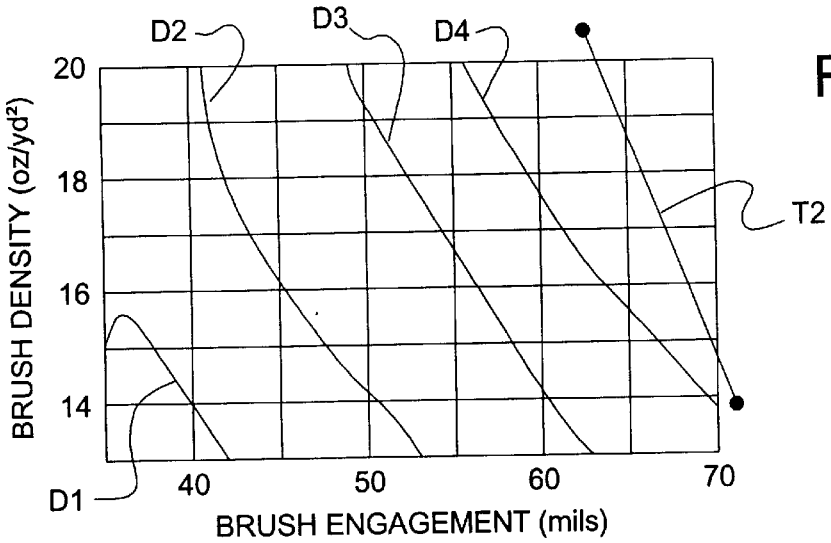

FIG. 4*b* is a contour plot showing torque contours as a function of engagement and fiber density.

Figure 4C:
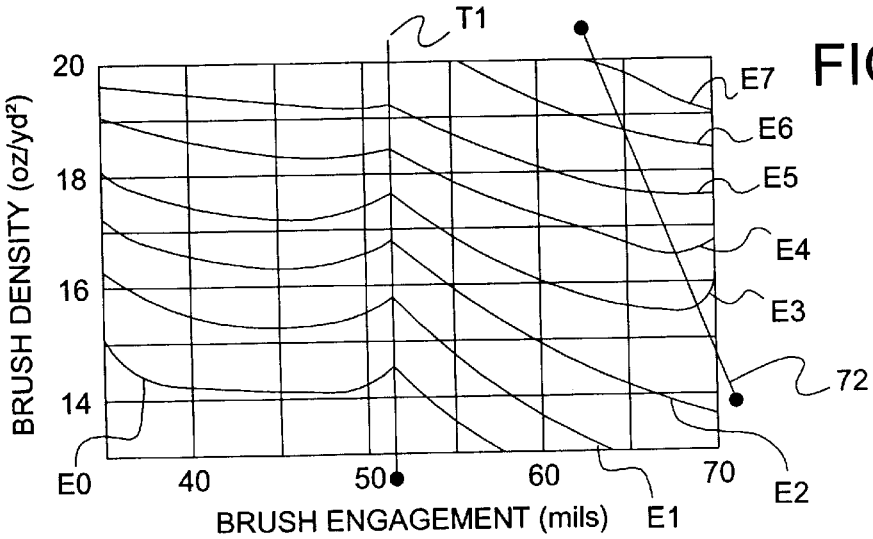

FIG. 4*c* applies the torque limit of FIG. 3*b* to FIG. 3*a*.

DESCRIPTION OF THE PREFERRED EMBODIMENT

Figure 1:
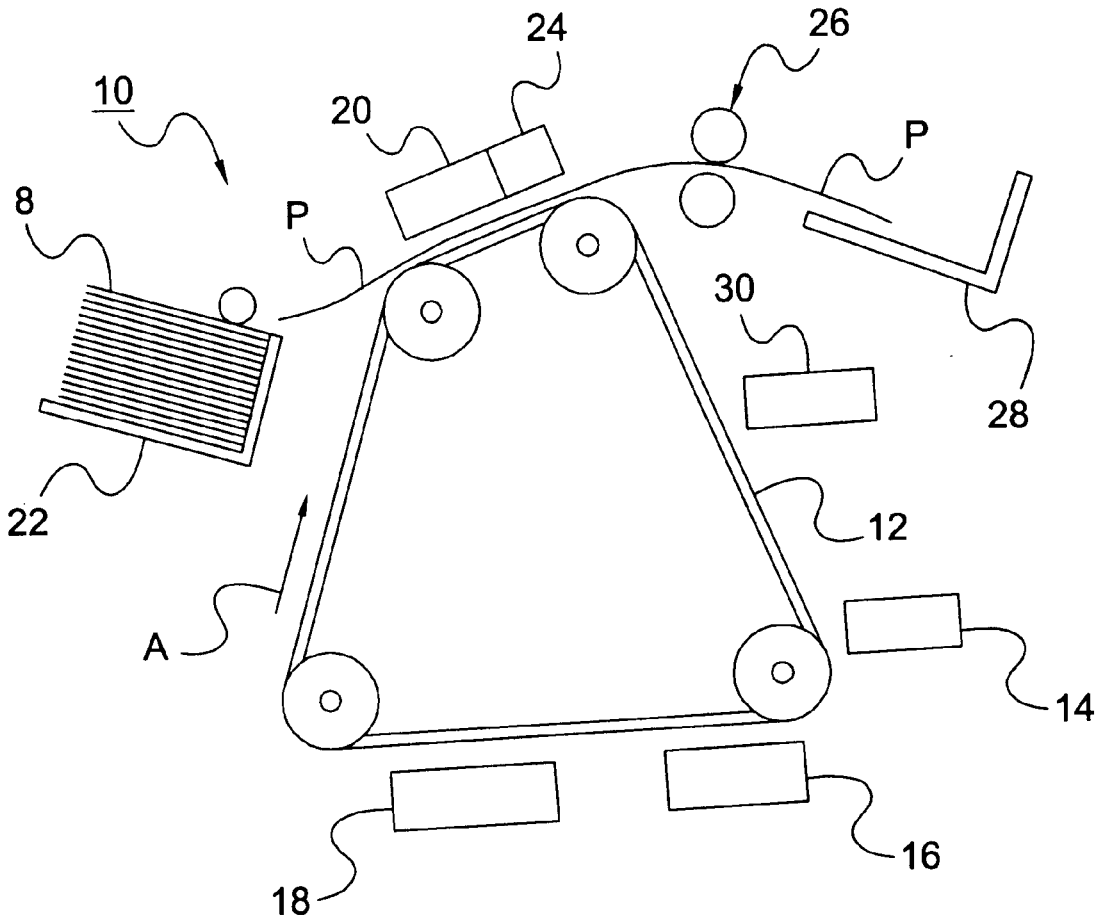
FIG. 1 is a schematic representation of a copier/printer.

Referring now to the accompanying drawings, FIG. 1 schematically illustrates a typical reproduction apparatus 10, of the electrophotographic type, suitable for utilizing an exemplary roller transfer assembly such as shown and described in aforementioned U.S. Pat. No. 6,097,913. The reproduction apparatus 10, described herein only to the extent necessary for a complete understanding of this invention, includes a photo conductor or equivalent film member 12. The film member 12 is, for example, in the form of an elongated endless web mounted on support rollers and movable about a closed loop path through a series of electro graphic process stations in the direction of the arrow A.

In the reproduction cycle for the reproduction apparatus 10, the moving film member 12 is uniformly charged as it moves past a charging station 14. Thereafter the uniformly charged dielectric member passes through an exposure station 16 where the uniform charge is altered to form a latent image charge pattern corresponding to information desired to be reproduced. Depending upon the characteristics of the dielectric member and the overall reproduction system, formation of the latent image charge pattern may be accomplished by exposing the dielectric member to a reflected light image of an original document to be reproduced or "writing" on the dielectric member with a series of lamps (e.g., LED's or lasers) or point electrodes activated by electronically generated signals based on the desired information to be reproduced. The latent image charge pattern on the film member 12 is then brought into association with a development station 18 which applies pigmented marking particles to adhere to the dielectric member to develop the latent image. The portion of the dielectric member carrying the developed image then passes through a transfer station 20 in register with a receiver member 8 fed in proper timed relation from a supply hopper 22 along the path P. An electric field produced in the transfer station attracts the marking particle of the developed image from the dielectric member to the receiver member.

The electric transfer field may also cause the receiver member 8 to adhere to the dielectric member. Accordingly, a detach mechanism 24, immediately downstream in the direction of travel of the dielectric member, is provided to facilitate removal of the receiver member from the dielectric member. The detach mechanism may be, for example, an AC corona charger for neutralizing the attractive field holding the receiver member to the dielectric member. After the developed image is transferred to the receiver member and the receiver member is separated from the dielectric member, the receiver member is transported through a fusing device 26 where the image is fixed to the receiver member by heat and/or pressure for example, and delivered to an output hopper 28 for operator retrieval. Simultaneously, the film member 12 is cleaned of any residual marking particles at cleaning station 30 and returned to the charging station 14 for reuse.

Figure 2:
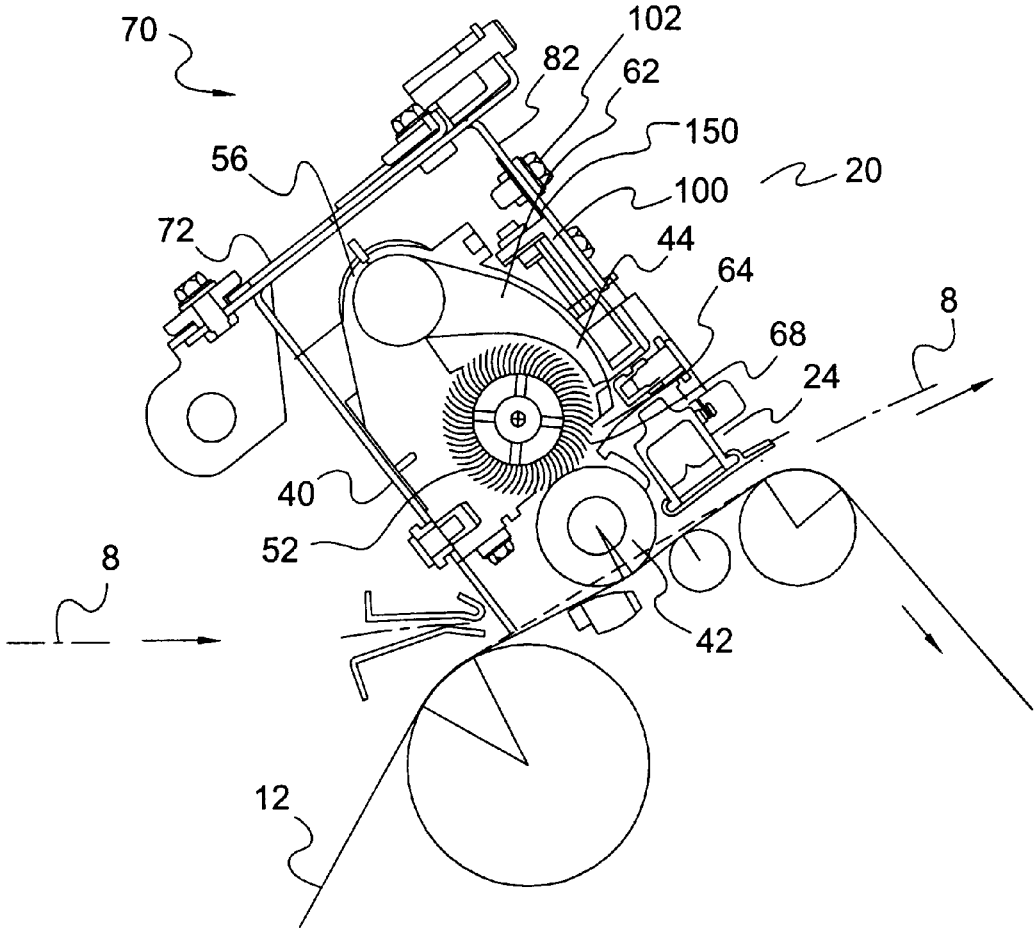
FIG. 2 is a detailed view of the transfer roller assembly.

Turning now to the exemplary transfer station 20, as noted above such station is for example a roller transfer assembly which is described herein below with particular reference to FIG. 2 in sufficient detail for a complete understanding of this invention. Of course, other roller transfer assemblies are suitable for use with this invention. The roller transfer assembly includes a unitary housing 40 containing a transfer roller 42, a roller cleaning mechanism 44, and a detach mechanism 24 in a compact configuration. An electrical bias is applied to the core of the roller 42 from a voltage limited constant current power supply (not shown). As such, when the transfer roller is in operative association with the dielectric member 12 (as shown in FIG. 2), an electrical transfer field is established which will efficiently transfer a developed image from the dielectric member to a receiver member passing there between.

When the transfer roller 42 contacts the film member 12 and there is no receiver member 8 between them, the transfer roller tends to pick up residual marking particles from the dielectric member. On subsequent passes of receiver members to accomplish developed image transfer, the marking particles on the transfer roller 42 can be deposited on the back side of the receiver members to form undesirable marks thereon. Accordingly, the transfer roller 42 must be efficiently continuously cleaned. The cleaning mechanism 44 of the roller transfer assembly 20 includes an elongated, cylindrical, fiber brush 52. The brush 52 is supported in the unitary housing 40 such that the longitudinal axis of the brush is parallel to the longitudinal axis of the transfer roller 42. The respective longitudinal axes are spaced apart a distance such that a portion of the peripheral surface of the brush 52 contacts the transfer roller 42. A motor 56, attached to the unitary housing 40, is coupled to the brush 52 to rotate the brush at a high rate of speed and preferably in a direction such that, in the area of contact between the brush and the transfer roller, the two are moving in opposite directions to effectively sweep marking particles (and any accumulated paper dust) from the transfer roller into the fibers of the brush.

In order to keep the fibers of the brush 52 from becoming overloaded with marking particles cleaned from the transfer roller 42, the cleaning mechanism 44 also includes a vacuum air flow system 62. The vacuum air flow system 62, in flow communication with a vacuum blower (not shown), forms an air flow directing chamber about the brush 52. The air flow chamber provides an air flow passage wrapping about a portion of the brush 52 with an opening 64 to the brush adjacent to the peripheral surface of the brush downstream (in the direction of rotation of the brush) from the area of contact between the brush and the transfer roller and extending in the direction of the longitudinal axis of the brush. A lip 68 extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

The distance between the axes of rotation of the transfer roller 42 and cleaning brush 52 is normally fixed. The techniques described in this patent enables one skilled in the art to determine the acceptable distance between the centers of the brush and roller and design the transfer station for a chosen cleaning brush. In the alternative, the center-to-center distance may be set by any suitable mechanism. For example, the axis of the cleaning brush could be mounted in bearings that are positioned in longitudinal slots adjacent the bearings. When the bearings are set at their desired positions, they may be locked into position by any suitable means. The bearings could be set to move in discrete increments by using a ratchet mechanism on each adjusting slot. Those skilled in the art are capable of providing those and other adjusting mechanisms. The transfer roller is held against the film by the transfer roller adjusting bracket. The cleaning brush has its own axial adjustor (not shown) for setting the distance between the axis of the transfer roller and cleaning brush 42, 52. Once the rollers are relatively positioned with respect to each other, their engagement is fixed and the engagement force between them remains relatively constant during machine operation.

The detach mechanism 24 of the roller transfer assembly is preferably an AC corona charger interconnected with the unitary housing 40. The detach mechanism 24 is located such that when the roller transfer assembly 20 is in operative association with the dielectric member 12, the detach charger is located downstream (in the direction of dielectric member travel) from the transfer roller 42 to effectively provide a field which relieves the electrostatic attraction forces between the receiver member and the dielectric member. In this manner, the receiver member is readily detached from the dielectric member for transport along its intended path P to the fusing device 26 (FIG. 1) without interference or jamming.

Turning now to FIGS. 3*a*–3*c*, the brush 52 is urged against the transfer roller 42 with a force F sufficient to bring the fibrous bristles 500 of the brush 52 into contact with the transfer roller 42. The force F depends upon the engagement distance between the cleaning brush and the transfer roller. The transfer roller 42 is free to rotate and is driven by the film 12 in the direction of arrow A. The cleaning brush is driven in the opposite direction (arrow B) by the motor 56. FIG. 3*a* shows portions of the roller and brush before engagement and FIG. 3*c* shows the corresponding portions after engagement. The fibrous bristles 500 are deflected against the roller 42 by the engaging force F. That force applies a frictional drag to the transfer roller 42 via the bristles 500. In one embodiment the fibers of the brush are made of acrylic material, but other materials are readily substituted for acrylic including and not limited to nylon, polypropylene, or natural animal or vegetable fibers. That frictional drag is opposite in direction to the drive torque that is applied by the film 12. If the applied engagement force F is too great, the transfer roller will slip or stall with respect to the film 12.

As described below, the cleaning performance substantially improves when the engagement between the transfer roller and the cleaning brush is greater than a minimal threshold so long as the engagement does not generate a slip or stall torque on the transfer roller. Engagement is the distance between the roller and the brush that exceeds a position where the bristles of the brush just touch the outside surface of the transfer roller. Cleaning is also improved by increasing the density of the fibers 500 in the cleaning brush 52. Taken together, there are ranges of engagement and fiber density that improve overall cleaning performance without exceeding a drag that equals or exceeds the stall torque of the transfer roller 42.

The invention addresses the improvement in cleaning efficiency of a transfer roller cleaning subsystem using a rotating acrylic fiber brush. It is known in the art that to improve cleaning efficiency of a brush system, increasing the fiber density and the brush engagement with the surface being cleaned will provide an improvement in the cleaning performance. As an example, in the exemplary design, the fiber density is 13.5 oz-yd$^2$ and the engagement is +0.035". Engagement is measured as the distance the fibers are "pushed" into the surface being cleaned. At 0" engagement, the tips of the fibers would be just touching the surface to be cleaned. Testing has shown, however, that cleaning performance does not improve as engagement is increased until a critical engagement is reached. In the an exemplary design, this critical engagement appears to be around 0.050–0.060".

The contour plot (FIG. 4*a*) illustrates this. The plot shows lines E0–E7 of constant cleaning performance. The numbers are part of a relative scale with increasing numbers indicating improvement (in dB) in cleaning efficiency. Each line represents roughly a 12% change in cleaning performance. The relationship between %change and dB is given by:

$$\%\text{change}=\{[10^{(\Delta dB/20)}]-1\}\times 100$$

Consider the cleaning performance for a brush density of 14.0 oz/yd$^2$. From the baseline engagement of 35 mils to approximately 53 mils (T1), there is no significant improvement in cleaning performance. However, increasing the engagement an additional 17 mils yields approximately a 1.5 dB improvement or 19% improvement in cleaning efficiency.

Cleaning performance sensitivity to increasing brush density is also increased above this critical engagement point. For an engagement of 35 mils, if the density is increased from 14 oz/yd$^2$ to 18 oz/yd$^2$, the cleaning efficiency improves by roughly 3 dB or 41%. This improvement is essentially constant until the engagement exceeds roughly 53 mils. At 70 mils engagement, this density increase yields a 4.2 dB improvement or 62% in cleaning efficiency.

It is shown then, that to realize the maximum improvement in cleaning efficiency, the brush engagement must exceed the first critical level T1. Beyond that point, increasing engagement and fiber brush density will increase cleaning performance of the roller surface. As this is done, the torque needed to turn the roller is increased as shown in the contour plot of FIG. 4*b*. The roller being cleaned by the brush is turned by frictional forces between the roller and the film it is running against. The cleaning brush runs counter current to this rotation. Therefore, if the torque gets too high, the roller can stall. This will result in both paper handling and image quality problems. The maximum allowable torque (T2) then constrains the range of brush engagement and fiber brush density combinations that can be considered. This information then begins to build a set of design requirement for the cleaning brush. These requirements are:

$$\text{Brush Engagement}>\text{Eng}_{Critical}$$

$$\text{Torque}<\text{Torque}_{MAXIMUM}$$

For the exemplary design the data suggests that:

$$\text{EngCritical}\cong 0.053''$$

$$\text{Torque}_{MAXIMUM}\cong 6\text{ in-oz.}$$

If the torque limit line expressed as a function of brush density and brush engagement is superimposed on the contour plot for cleaning performance, it becomes clear what the best combination of brush density and engagement should be. See FIG. 4*c*. A design setpoint is chosen between T1 and T2 that results in maximum cleaning performance while keeping torque transferred to the roller below the critical limit. For the current exemplary design, this appears to be suggest that maximum performance can be obtained when:

$$\text{Engagement}\cong 55\text{–}60\text{ mils}$$

$$\text{Brush Density}\cong 20\text{–}22\text{ oz/yd}^2$$

It should be understood that this strategy for designing a roller cleaning subsystem using a rotation fiber brush is applicable to a wide variety of designs. The specific values discussed are for the exemplary design specifically and are only shown here to illustrate the design process.

The foregoing experimental results show there is lower, minimal engagement above which the cleaning performance improves. The lower, minimal engagement is identified by a relatively constant cleaning performance over a substantial range of engagement. As shown in FIG. A there is a distinct engagement threshold at about 53 mils. Below that threshold, the cleaning performance is relatively constant. Above that threshold, the performance continuously improves until the transfer roller slips or stops at its stall torque. See FIG. B. Brushes with increased density also have increased cleaning performance up to the limit of the stall torque.

Having described one exemplary design, those skilled in the art can adapt this design to other applications and designs and remain within the scope of the appended claims. For example, the invention may be applied to clean any transfer roller that transfers powder from a powder carrying surface to a receiver sheet.

What is claimed is:

1. In a machine having an endless belt or drum that can carry a powder material on a surface of the endless belt or drum, a process for improving cleaning of one of the members of said machine, comprising:

driving the endless belt or drum past a transfer station;

engaging the endless belt or drum with a transfer roller for turning the transfer roller in a first direction of rotation;

electrically biasing the transfer roller to transfer powder material from the surface of the endless belt or drum to a receiver sheet;

rotating a cleaning brush having a surface comprising a plurality of fibrous bristles in an opposite direction with respect to the transfer roller to remove residual powder material from the transfer roller;

engaging the cleaning brush and the transfer roller by moving the relative location of the axes of rotation of the brush and the roller toward each other, said engagement being greater than a minimal engagement that removes a relatively constant amount of residual powder material from the transfer roller and less than an engagement that slips or stalls the transfer roller.

2. The method of claim 1 wherein the machine is a copy machine or a printer and the powder material is toner material.

3. A machine having an endless belt or drum that carries a powder material on a surface of the endless belt or drum, comprising:

a transfer roller disposed in engagement with the endless belt or drum and rotated in a first direction determined by the direction of travel of the endless belt or drum;

a source of electrical bias coupled to the transfer roller for electrically biasing the transfer roller to transfer powder material from the surface of the endless belt or drum to a receiver sheet;

a cleaning brush having a surface comprising a plurality of fibrous bristles and rotating in a direction opposite to the direction of rotation of the transfer roller for removing residual powder material from the transfer roller;

wherein the axes of rotation of the roller and brush with respect to each other are set a distance apart to provide an engagement between the transfer roller and the cleaning brush, said engagement being greater than a minimal engagement that removes a relatively constant amount of residual powder material from the transfer roller and less than an engagement that slips or stalls the transfer roller.

4. The machine of claim 3 wherein the machine comprises a copier or a printer and the powder comprises toner particles.

5. A photocopier or printer having a transfer roller and a cleaning station for cleaning the transfer roller comprising:

a transfer roller frictionally engaged with a photo conductor or equivalent film for turning in a first direction;

means for electrically biasing the transfer roller to attract toner particles from the photo conductor or equivalent film to a receiver sheet;

a cylindrical cleaning brush having a surface covered with fibrous bristles for removing residual toner particles from the transfer roller;

a motor for turning the cleaning brush in a direction opposite to the direction of rotation of the transfer roller;

means for adjusting the relative distance between the axes of rotation of the transfer roller and cleaning brush to increase the engagement between the roller and the brush to be greater than a minimal engagement that removes a relatively constant amount of residual toner from the transfer roller and less than an engagement that slips or stalls the transfer roller.

6. A method for adjusting a transfer roller cleaning system to clean the transfer roller as the roller is driven by a photo conductor or equivalent that carries a developed toner image past the transfer roller comprising the steps of:

determining stall torque for slipping or stopping the rotation of the transfer roller that is driven by the passing photo conductor or equivalent;

providing a cleaning brush comprising a plurality of fibrous bristles extending from the cleaning brush for contacting the transfer roller to remove residual developing materials from the transfer roller;

driving the cleaning brush in a direction opposite to the direction of the transfer roller;

engaging the bristles of the cleaning brush against the transfer roller with an initial engagement to press the bristles of the cleaning brush against the transfer roller and deflect the bristles against the transfer roller to thereby begin removing at least some residual developing material from the transfer roller;

increasing the engagement between the cleaning brush and the transfer roller until the cleaning brush removes substantially more material than is removed with the initial engagement and generates a low enough drag to avoid stopping or slipping the transfer roller.

7. The method of claim 6 further comprising the step of increasing the density of the bristles in the cleaning brush roller.

8. The method of claim 6 wherein the drag depends upon the density of the fibrous bristles of the cleaning brush and the applied engagement that deflects the bristles against the transfer roller.

9. A method for adjusting a transfer roller cleaning system to clean the transfer roller as the roller is driven by a photo conductor or equivalent that carries a developed toner image past the transfer roller comprising the steps of:

determining stall torque for slowing or stopping the rotation of the transfer roller that is driven by the passing photo conductor or equivalent;

providing a cleaning brush comprising a plurality of fibrous bristles extending from the cleaning brush for contacting the transfer roller to remove residual developing materials from the transfer roller;

driving the cleaning brush in a direction opposite to the direction of the transfer roller;

engaging the bristles of the cleaning brush against the transfer roller with an initial engagement to press the bristles of the cleaning brush against the transfer roller and deflect the bristles against the transfer roller to remove residual developing material from the transfer roller;

increasing the density of the fibrous bristles on the cleaning brush to remove substantially more residual developing material without generating a drag that slips or stall the transfer roller.

10. A method for adjusting a transfer roller cleaning system to clean the transfer roller as the roller is driven by a photo conductor or equivalent that carries a developed image past the transfer roller comprising the steps of:

determining stall torque for slowing or stopping the rotation of the transfer roller that is driven by the passing photo conductor or equivalent;

providing a cleaning brush comprising a plurality of fibrous bristles extending from the cleaning brush for contacting the transfer roller to remove residual developing materials from the transfer roller;

driving the cleaning brush in a direction opposite to the direction of the transfer roller;

engaging the bristles of the cleaning brush against the transfer roller with an initial engagement to press the bristles of the cleaning brush against the transfer roller and deflect the bristles against the transfer roller to thereby begin removing at least some residual developing material from the transfer roller;

increasing the engagement between the cleaning brush and the transfer roller until the cleaning brush removes substantially more material than is removed with the initial engagement force but with a force that generates a torque less than the stall torque of the transfer roller; and increasing the density of the fibrous bristles on the cleaning brush to remove substantially more residual developing material without generating a drag that slips or stalls the transfer roller.

* * * * *